US012492855B2

(12) United States Patent
Aschow et al.

(10) Patent No.: US 12,492,855 B2
(45) Date of Patent: Dec. 9, 2025

(54) REFRIGERATION SYSTEM WITH WARM DEFROST

(71) Applicant: Effecterra, Inc., Reno, NV (US)

(72) Inventors: Evan Aschow, Fair Oaks, CA (US); Chad Bartley, Reno, NV (US); Mark Atherton, Reno, NV (US); Michael May, Reno, NV (US)

(73) Assignee: EFFECTERRA, INC., Reno, NV (US)

( * ) Notice: Subject to any disclaimer, the term of this patent is extended or adjusted under 35 U.S.C. 154(b) by 114 days.

(21) Appl. No.: 18/598,549

(22) Filed: Mar. 7, 2024

(65) Prior Publication Data

US 2025/0283653 A1 Sep. 11, 2025

(51) Int. Cl.
*F25D 21/00* (2006.01)

(52) U.S. Cl.
CPC ..... *F25D 21/002* (2013.01)

(58) Field of Classification Search
CPC .. F25B 47/022; F25B 1/10; F25B 5/02; F25B 9/008
See application file for complete search history.

(56) References Cited

U.S. PATENT DOCUMENTS 3,074,249 A 1/1963 Henderson
3,184,926 A * 5/1965 Blake ..... F25B 5/02 62/81
3,358,469 A 12/1967 Quick
3,766,745 A 10/1973 Quick
4,167,102 A * 9/1979 Willitts ..... F25B 5/02 62/81
4,454,725 A 6/1984 Cann
4,589,263 A 5/1986 Dicarlo et al.
4,621,505 A 11/1986 Ares et al.
(Continued)

FOREIGN PATENT DOCUMENTS

WO WO-2009/052369 A2 4/2009
WO WO-2009/127062 A1 10/2009
WO WO-2011/049767 A2 4/2011

OTHER PUBLICATIONS

Extended European Search Report for EP Application No. 12851221.7, mailed Aug. 19, 2015, 6 pages.
(Continued)

*Primary Examiner* — Lionel Nouketcha
(74) *Attorney, Agent, or Firm* — Foley & Lardner LLP

(57) ABSTRACT

A method for defrosting an evaporator of a refrigeration system includes providing a refrigeration system including a low temperature (LT) compressor, a medium temperature (MT) compressor, a low temperature evaporator, and a medium temperature evaporator. The method includes initiating a defrost cycle for the refrigeration system by closing a return valve to shut off refrigerant return to the LT compressor from an outlet of the low temperature evaporator and opening a defrost supply valve to define a fluid flow path between a suction side of the MT compressor and an outlet of the low temperature evaporator. The method includes operating the LT compressor and the MT compressor such that warm refrigerant from the suction side of the MT compressor is provided through the low temperature evaporator and returned to a suction side of the LT compressor through a hot gas tank.

19 Claims, 9 Drawing Sheets

(56) References Cited

U.S. PATENT DOCUMENTS

| | | | | |
|---|---|---|---|---|
| 4,660,384 | A | 4/1987 | Pallanch | |
| 5,400,615 | A | 3/1995 | Pearson | |
| 5,596,878 | A | 1/1997 | Hanson et al. | |
| 6,170,272 | B1 | 1/2001 | Backman | |
| 7,610,766 | B2 | 11/2009 | Dube | |
| 9,261,299 | B2 | 2/2016 | Ahmed et al. | |
| 9,377,236 | B2 | 6/2016 | Hinde et al. | |
| 2005/0257564 | A1 | 11/2005 | Wightman | |
| 2010/0205984 | A1* | 8/2010 | Gu | F25D 11/022 62/81 |
| 2011/0154840 | A1 | 6/2011 | Mihara et al. | |
| 2014/0352343 | A1* | 12/2014 | Hinde | F25B 7/00 62/277 |
| 2023/0070186 | A1* | 3/2023 | Sakthivel | F25B 40/02 |
| 2023/0408166 | A1* | 12/2023 | Zha | F25B 41/20 |

OTHER PUBLICATIONS

International Preliminary Report on Patentability for PCT Application No. PCT/US2012/065522, dated May 27, 2014, 8 pages.
International Search Report and Written Opinion for PCT Application No. PCT/US2012/065522, mail date Feb. 8, 2013, 9 pages.

* cited by examiner

REFRIGERATION SYSTEM WITH WARM DEFROST

BACKGROUND

The present disclosure relates generally to a refrigeration system with defrosting feature. More particularly, the present disclosure relates to carbon dioxide (CO2) compression systems.

SUMMARY

One implementation of the present disclosure is a refrigeration system, according to some embodiments. In some embodiments, the refrigeration system includes a low temperature (LT) compressor, a medium temperature (MT) compressor, a low temperature evaporator, and a medium temperature evaporator. In some embodiments, a suction side of the MT compressor is fluidly coupled with a discharge side of the LT compressor. In some embodiments, the low temperature evaporator is configured to provide cooling to a low temperature space. In some embodiments, the medium temperature evaporator is configured to provide cooling to a medium temperature space. In some embodiments, the refrigeration system is configured to perform a refrigeration cycle to maintain the medium temperature space at a first temperature and the low temperature space at a second temperature lower than the first temperature. In some embodiments, refrigerant from the low temperature evaporator is returned to a suction side of the LT compressor, and refrigerant from the medium temperature evaporator returned to a connection point downstream of a discharge side of the LT compressor and upstream of a suction side of the MT compressor. In some embodiments, the refrigeration system is configured to perform a defrost cycle by using warm refrigerant from a suction side of the MT compressor and directing the warm refrigerant to pass through the medium temperature evaporator in a reverse direction, the warm refrigerant used for the defrost cycle drawn from a position downstream of the connection point and upstream of the suction side of the MT compressor.

In some embodiments, the refrigeration system includes a flash tank, and a hot gas tank. In some embodiments, the flash tank fluidly is coupled with an outlet of a gas cooler fluidly coupled with a discharge side of the MT compressor. In some embodiments, the flash tank is fluidly coupled with an inlet of the medium temperature evaporator and, through a header, an inlet of the low temperature evaporator. In some embodiments, the hot gas tank is fluidly coupled at a lower end with an inlet of the low temperature evaporator and configured to receive the warm refrigerant returned from the inlet of the low temperature evaporator during the defrost cycle. In some embodiments, an outlet of the hot gas tank fluidly coupled with the suction side of the LT compressor to return the warm refrigerant to the LT compressor.

In some embodiments, in response to a presence of fluid being detected in the hot gas tank, the refrigeration system is configured to allow refrigerant from the hot gas tank to return to the header by closing a valve that fluidly couples an outlet of the flash tank with the header. In some embodiments, closing the valve causes a pressure drop to occur in the header which draws the refrigerant from the hot gas tank into the header.

In some embodiments, in response to fluid in the hot gas tank being at an upper threshold of fill level, the refrigeration system is configured to implement a flush cycle by (1) closing a return valve to restrict the return of refrigerant from the hot gas tank to the suction side of the LT compressor, and (2) modulating a valve that fluidly couples the hot gas tank with the discharge side of the MT compressor to maintain a pressure in the hot gas tank at least a specific amount above a pressure of the flash tank such that refrigerant exits the hot gas tank and is flushed into the flash tank. In some embodiments, the refrigerant is carbon dioxide (CO2).

In some embodiments, the refrigeration system includes a heat exchanger through which the warm refrigerant passes before entering the low temperature evaporator for defrosting. In some embodiments, the warm refrigerant is configured to absorb latent heat while passing through the heat exchanger.

In some embodiments, the refrigeration system further includes a three-way valve positioned downstream of the discharge side of the MT compressor. In some embodiments, the three-way valve is configured to transition into a position to direct hot refrigerant from the MT compressor into the heat exchanger to provide latent heat to the warm refrigerant for defrosting.

Another implementation of the present disclosure is a refrigeration system, according to some embodiments. In some embodiments, the refrigeration system includes a low temperature (LT) compressor, a medium temperature (MT) compressor, a low temperature evaporator, a medium temperature evaporator, and a control system. In some embodiments, a suction side of the MT compressor is fluidly coupled with a discharge of the LT compressor. In some embodiments, the low temperature evaporator is configured to provide cooling to a low temperature space and the medium temperature evaporator is configured to provide cooling to a medium temperature space. In some embodiments, the LT compressor and the MT compressor are configured to discharge a refrigerant through the low temperature evaporator and the medium temperature evaporator for refrigeration. In some embodiments, the control system includes processing circuitry configured to initiate a defrost cycle for the refrigeration system by closing a return valve to shut off refrigerant return to the LT compressor from an outlet of the low temperature evaporator and opening a defrost supply valve to define a fluid flow path between a suction side of the MT compressor and an outlet of the low temperature evaporator. In some embodiments, the processing circuitry is configured to operate the LT compressor and the MT compressor such that warm refrigerant from the suction side of the MT compressor is provided through the low temperature evaporator and returned to a suction side of the LT compressor through a hot gas tank.

In some embodiments, the processing circuitry is further configured to operate a three-way valve to direct hot refrigerant from a discharge side of the MT compressor to flow through a heat exchanger through which the warm refrigerant from the suction side of the MT compressor flows such that the warm refrigerant from the suction side of the MT compressor absorbs heat from the hot refrigerant from the discharge side of the MT compressor while passing through the heat exchanger before entering the low temperature evaporator for defrosting. In some embodiments, the processing circuitry is configured to obtain, from a temperature sensor, a temperature of the warm refrigerant after the warm refrigerant passes through the heat exchanger. In some embodiments, the processing circuitry is configured to at least one of verify heat exchange at the heat exchanger based on the temperature or control the three-way valve to adjust the temperature of the warm refrigerant.

In some embodiments, the processing circuitry is further configured to modulate a return refrigerant valve on a return line from the hot gas tank to the suction side of the LT compressor to maintain a pressure differential between a supply and a return of the warm refrigerant for the defrost cycle. In some embodiments, the processing circuitry is configured to obtain feedback from a low level switch of the hot gas tank, the feedback of the low level switch indicating a presence of fluid in the hot gas tank. In some embodiments, the processing circuitry is configured to, responsive to the feedback from the low level switch indicating the presence of fluid in the hot gas tank, allow refrigerant to exit the hot gas tank into a refrigeration header of the low temperature evaporator by closing a valve that fluidly couples an outlet of a flash tank with the refrigeration header to produce a pressure drop in the refrigeration header such that the refrigerant in the hot gas tank is drawn into the refrigeration header.

In some embodiments, the processing circuitry is configured to obtain feedback from a high level switch of the hot gas tank, the feedback of the high level switch indicating that fluid in the hot gas tank has reached an upper threshold. In some embodiments, the processing circuitry is configured to, responsive to the feedback from the high level switch indicating that fluid in the hot gas tank has reached the upper threshold, perform a flush sequence to flush refrigerant from the hot gas tank into a flash tank fluidly coupled with the hot gas tank. In some embodiments, the flush sequence is performed by closing a return defrost valve that fluidly couples the hot gas tank with the suction side of the LT compressor and modulating a valve that fluidly couples the hot gas tank with the discharge of the MT compressor in order to maintain pressure in the hot gas tank above a pressure of the flash tank such that the refrigerant in the hot gas tank is flushed into the flash tank. In some embodiments, the refrigerant is carbon dioxide (CO2).

Another implementation of the present disclosure is a method for defrosting an evaporator of a refrigeration system, according to some embodiments. In some embodiments, the method includes providing a refrigeration system including a low temperature (LT) compressor, a medium temperature (MT) compressor, a low temperature evaporator, and a medium temperature evaporator. In some embodiments, a suction side of the MT compressor is fluidly coupled with a discharge of the LT compressor. In some embodiments, the low temperature evaporator is configured to provide cooling to a low temperature space and the medium temperature evaporator configured to provide cooling to a medium temperature space, the LT compressor and the MT compressor configured to discharge a refrigerant through the low temperature evaporator and the medium temperature evaporator for refrigeration. In some embodiments, the method includes initiating a defrost cycle for the refrigeration system by closing a return valve to shut off refrigerant return to the LT compressor from an outlet of the low temperature evaporator and opening a defrost supply valve to define a fluid flow path between a suction side of the MT compressor and an outlet of the low temperature evaporator. In some embodiments, the method includes operating the LT compressor and the MT compressor such that warm refrigerant from the suction side of the MT compressor is provided through the low temperature evaporator and returned to a suction side of the LT compressor through a hot gas tank.

In some embodiments, the method includes operating a three-way valve to direct hot refrigerant from a discharge side of the MT compressor to flow through a heat exchanger through which the warm refrigerant from the suction side of the MT compressor flows such that the warm refrigerant from the suction side of the MT compressor absorbs heat from the hot refrigerant from the discharge side of the MT compressor while passing through the heat exchanger before entering the low temperature evaporator for defrosting. In some embodiments, the method includes obtaining, from a temperature sensor, a temperature of the warm refrigerant after the warm refrigerant passes through the heat exchanger. In some embodiments, the method includes at least one of verifying heat exchange at the heat exchanger based on the temperature or controlling the three-way valve to adjust the temperature of the warm refrigerant.

In some embodiments, the method includes modulating a return refrigerant valve on a return line from the hot gas tank to the suction side of the LT compressor to maintain a pressure differential between a supply and a return of the warm refrigerant for the defrost cycle.

In some embodiments, the method includes obtaining feedback from a low level switch of the hot gas tank, the feedback of the low level switch indicating a presence of fluid in the hot gas tank. In some embodiments, the method includes, responsive to the feedback from the low level switch indicating the presence of fluid in the hot gas tank, allowing refrigerant to exit the hot gas tank into a refrigeration header of the low temperature evaporator by closing a valve that fluidly couples an outlet of a flash tank with the refrigeration header to produce a pressure drop in the refrigeration header such that the refrigerant in the hot gas tank is drawn into the refrigeration header.

In some embodiments, the method includes obtaining feedback from a high level switch of the hot gas tank. In some embodiments, the feedback of the high level switch indicates that fluid in the hot gas tank has reached an upper threshold. In some embodiments, the method includes, responsive to the feedback from the high level switch indicating that fluid in the hot gas tank has reached the upper threshold, performing a flush sequence to flush refrigerant from the hot gas tank into a flash tank fluidly coupled with the hot gas tank. In some embodiments, the flush sequence is performed by closing a return defrost valve that fluidly couples the hot gas tank with the suction side of the LT compressor and modulating a valve that fluidly couples the hot gas tank with the discharge of the MT compressor in order to maintain pressure in the hot gas tank above a pressure of the flash tank such that the refrigerant in the hot gas tank is flushed into the flash tank.

In some embodiments, the refrigerant is carbon dioxide (CO2). In some embodiments, the warm refrigerant is drawn from the suction side of the MT compressor downstream of a connection point at which refrigerant returns from the medium temperature evaporator during a refrigeration cycle.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
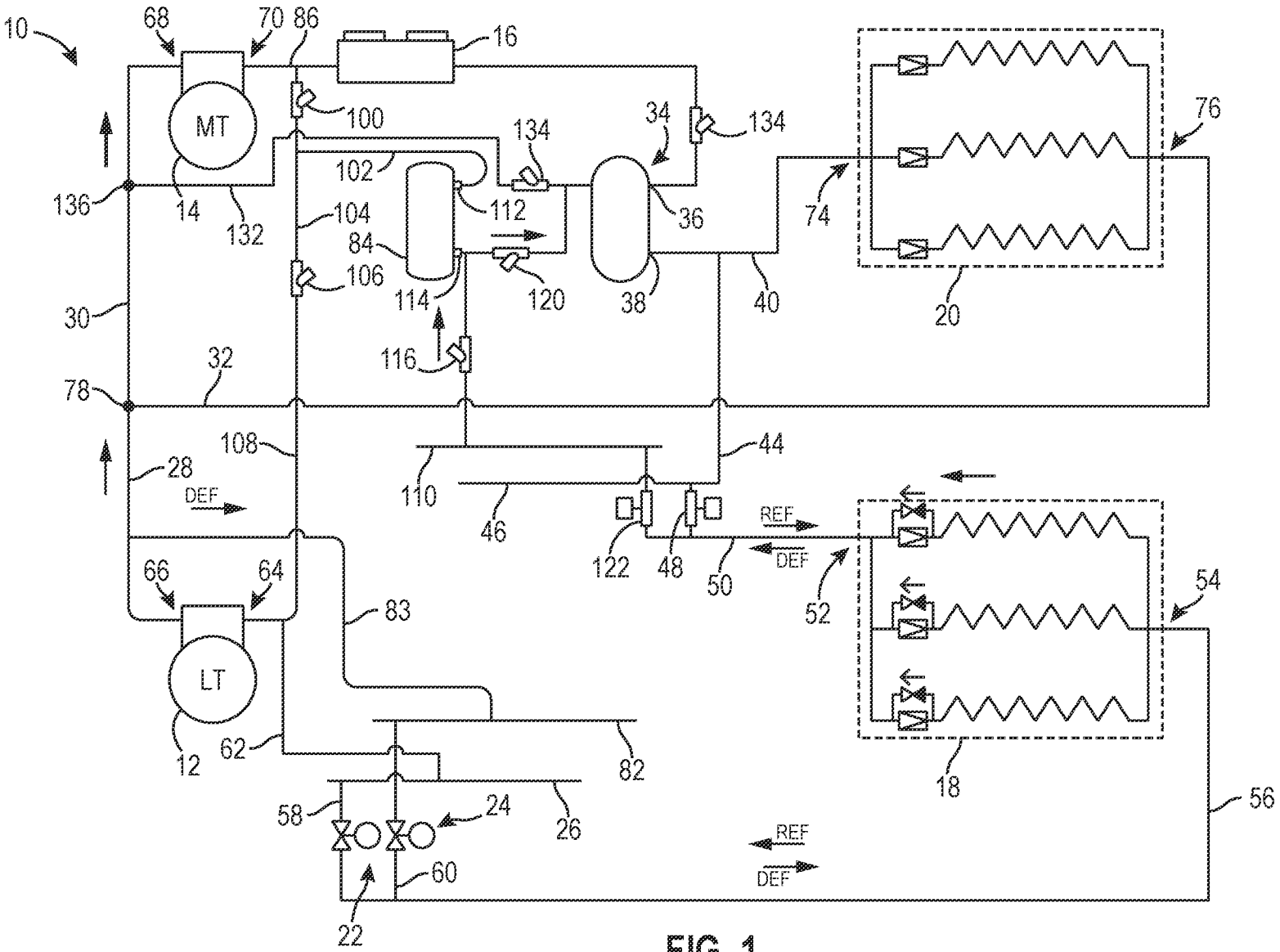
FIG. 1 is a diagram of a refrigeration system that can implement a defrost feature, according to some embodiments.

Before turning to the Figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Overview

Referring generally to the FIGURES, a refrigeration system includes a low temperature (LT) compressor that discharges into a suction side of a medium temperature (MT) compressor, a first evaporator (e.g., for a freezer), a second evaporator (e.g., for a refrigerator), a gas cooler, and a flash tank. During refrigeration cycles, the MT compressor discharges refrigerant through the gas cooler into the flash tank. The refrigerant exits the flash tank and is directed to the first evaporator and, through a header, to the second evaporator. The refrigerant from the second evaporator is recirculated to a suction side of the LT compressor. The refrigerant from the first evaporator is recirculated to a position downstream of the discharge side of the LT compressor and upstream of a suction side of the MT compressor.

The refrigeration system is also configured to implement a warm gas defrost cycle in which warm refrigerant flows through the evaporator(s) in a reverse direction. The refrigerant used for the defrosting is drawn from a suction side of the MT compressor. In some embodiments, the point at which the warm refrigerant is drawn for defrosting is upstream of the suction side of the MT compressor and downstream of the connection point at which refrigerant is recirculated from the first evaporator during refrigeration cycles. The warm refrigerant may pass through a heat exchanger that uses latent heat from refrigerant discharged by the MT compressor which is circulated through an opposing side of the heat exchanger. The refrigerant is provided to a defrost header which is fluidly coupled with an outlet side of the second evaporator. The warm refrigerant flows through (e.g., drips through) the second evaporator in a reverse direction compared to a direction of flow during refrigeration cycles. After exiting the second evaporator through the inlet, the warm refrigerant is discharged into a hot gas (HG) tank. The HG tank returns the warm refrigerant to a suction side of the LT compressor. In some embodiments, if the fluid level in the HG tank reaches a lower threshold, a valve that fluidly couples the flash tank with the header of the second evaporator (used during refrigeration cycles) is closed so that pressure in the header drops. The pressure drop in the header draws refrigerant out of the HG tank and into the header through a check valve which may advantageously reduce the amount of time required to perform the defrost cycle.

If the fluid level in the HG tank reaches an upper threshold, a flush cycle may be initiated such that fluid from the HG tank is flushed into the flash tank. The flush cycle can be implemented by closing a valve along the return path to the suction side of the LT compressor and modulating a valve that fluidly couples the HG tank with the discharge side of the MT compressor in order to maintain the pressure in the HG tank above a pressure of the flash tank such that the refrigerant can be flushed from the HG tank into the flash tank.

Refrigeration System

System Layout

Referring to FIG. 1, a diagram of a refrigeration system 10 is shown, according to some embodiments. The refrigeration system 10 may be configured for use for a refrigerated display case, a refrigerated container, etc. The refrigeration system 10 can include multiple compressors in parallel for compressing and driving refrigerant through the system. In some embodiments, the refrigerant used in the refrigeration system 10 is carbon dioxide (CO2).

The refrigeration system 10 includes a low temperature (LT) compressor 12, and a medium temperature (MT) compressor 14, according to some embodiments. The LT compressor 12 and the MT compressor 14 drive refrigerant through the system 10 for refrigeration and cooling of different temperature controlled zones (e.g., the interior of a refrigerator, the interior of a freezer, etc.). The refrigeration cycle of the system 10 illustrated in FIGS. 1-4 is described herein. The refrigeration system 10 also includes a first evaporator 18 and a second evaporator 20.

The LT compressor 12 is configured to discharge the refrigerant through a discharge conduit 28 that fluidly couples with a suction conduit 30. The refrigerant is discharged by the LT compressor 12 through a discharge side 66 of the LT compressor 12, through the discharge conduit 28 and the suction conduit 30 to a suction side 68 of the MT compressor 14. The MT compressor 14 receives the refrigerant through the suction side 68 and discharges the refrigerant through a discharge side 70 to a discharge conduit 86. The discharge conduit 86 is fluidly coupled with a gas cooler 16 that cools the refrigerant as the refrigerant passes through the gas cooler 16. After the refrigerant passes through the gas cooler 16, the refrigerant continues through the discharge conduit 86 at an outlet side of the gas cooler 16, passes through a high pressure valve (HPV), and enters a flash tank 34 (e.g., in a gas phase) through an inlet 36 to the flash tank 34. The refrigerant exits the flash tank 34 (e.g., in a liquid phase) through an outlet 38 and is transferred to the second evaporator 20 (e.g., a medium temperature evaporator) through conduit 40, and to an evaporator header 46 (e.g., a refrigeration header). The flash tank 34 may also be fluidly coupled (e.g., to maintain pressure) from the suction conduit 30 through a conduit 132 that fluidly couples the flash tank 34 with the suction conduit 30 at a point 136 through a flash gas bypass valve 134. The second evaporator 20 is fluidly coupled with the conduit 40 at an inlet 74. The refrigerant passes through the second evaporator 20 and cools a corresponding temperature controlled space while passing through the second evaporator 20. The refrigerant absorbs heat while passing through the second evaporator 20, and exits the second evaporator 20 through an outlet 76. The refrigerant is then re-circulated back to the suction conduit 30 through a return conduit 32. The return conduit 32 fluidly couples with the suction conduit 30 at a connection point 78.

The evaporator header 46 is fluidly coupled with the conduit 40 through a conduit 44 that branches from the conduit 40. The evaporator header 46 is fluidly coupled with an evaporator supply conduit 50 through a valve 48. During refrigeration, the valve 48 is in an open position such that the refrigerant can pass from the evaporator header 46 to the evaporator supply conduit 50 through the valve 48. The refrigerant enters the first evaporator 18 (e.g., a low temperature evaporator) through an inlet 52. As the refrigerant passes through the first evaporator 18, the refrigerant cools a corresponding temperature controlled zone, absorbing heat from the temperature controlled zone. The refrigerant exits the first evaporator 18 through an outlet 54. The system 10 includes a return conduit 56 that is fluidly coupled with the first evaporator 18 through the outlet 54. The refrigerant is returned through the return conduit 56 to a valve 22 (e.g., a return valve). The valve 22 is in an open position during refrigeration of the system 10, and allows the refrigerant to return from the return conduit 56 through the valve 22 and a conduit 58 to a suction header 26. The suction header 26 is fluidly coupled with an inlet 64 of the LT compressor 12 through a return conduit 62.

Referring still to FIG. 1, the refrigeration system 10 is also configured to implement a defrost process in order to melt frost from coils of the evaporators 18 and 20. The defrost process implemented by the refrigeration system 10 utilizes warm refrigerant as opposed to external heaters. During the defrost process, the refrigerant may be passed through the second evaporator 20 and the first evaporator 18 in a reverse direction. The defrost process as implemented by the refrigeration system 10 is described herein.

When the defrost process (e.g., operation, mode, state of operation, etc.) is performed, the LT compressor 12 and the MT compressor 14 continue to operate similar as in refrigeration, but the refrigerant is directed through different conduits (e.g., in a reverse direction through the second evaporator 20 and the first evaporator 18). The defrost process can be initiated by operating the valve 48 (e.g., a liquid solenoid valve) is transitioned into a closed position, and after a short time delay (in order to allow the evaporator 20 to boil off any liquid), the valve 22 also closes. Once the valve 22 and the valve 48 are closed, a valve 122 and a valve 24 (e.g., a defrost supply valve) open. The valve 122 is fluidly coupled with a first defrost header 110 and receives warm refrigerant discharged from the first evaporator 18 through the valve 122 and the evaporator supply conduit 50. The valve 24 is fluidly coupled along a conduit 60 that fluidly couples with the return conduit 56 of the first evaporator 18 and a second defrost header 82. The second defrost header 82 is configured to receive refrigerant (e.g., warm refrigerant) from the discharge side 66 of the LT compressor 12. Specifically, the second defrost header 82 is configured to receive refrigerant from a position upstream of the connection point 78 and downstream of the discharge side 66 of the LT compressor 12. The valve 122 may be a solenoid valve or other valve (e.g., a ball valve) that is transitionable between an open position and a closed position.

During the defrost process, the LT compressor 12 discharges warm liquid refrigerant into the discharge conduit 28 which flows through a conduit 83 to the second defrost header 82. The second defrost header 82 is fluidly coupled with the return conduit 56 of the first evaporator 18 through the valve 24 and the conduit 60. The warm liquid refrigerant is directed through the conduit 60 and the return conduit 56 to the first evaporator 18. The warm refrigerant passes through the tubes of the first evaporator 18 and exits the second evaporator 20 through the inlet 52 (e.g., in a reverse direction as the refrigerant flows during cooling or refrigeration operations). The warm refrigerant exits the first evaporator 18 through the inlet 52, and is transferred through the supply conduit 50 and the valve 122 to the first defrost header 110. The warm refrigerant is then provided to a hot gas (HG) tank 84 via an inlet 114 at a bottom of the HG tank 84. The HG tank 84 includes a high level switch (near a top of the HG tank 84) and a low level switch (near a bottom of the HG tank 84). The HG tank 84 includes a first inlet 114 at which the first defrost header 110 is fluidly coupled with the HG tank 84 (near a bottom of the HG tank 84), and a second inlet 112 near a top of the HG tank 84 through which a conduit 102 is fluidly coupled. The conduit 102 is fluidly coupled with return conduits 104 and 108 that fluidly couple at a first end with the conduit 86 downstream of the outlet 70 of the MT compressor 14, and fluidly coupled with an inlet 64 of the LT compressor 12 at a second end. The conduit 102 is fluidly coupled with the return conduit 104 at a position between a valve 100 (e.g., a return refrigerant valve) and a valve 106 (e.g., a return defrost valve). The valve 100 is positioned between (i) a connection point of the return conduit 104 with the discharge conduit 86, and (ii) a connection point of the conduit 102 with the return conduit 104. The valve 106 is positioned downstream of the connection point between the conduit 102 and the return conduit 104, and upstream of the return conduit 108 and the LT compressor inlet 64. The valve 100 and the valve 106 may be modulation valves that are configured to control pressure, flow, or speed of fluid therethrough.

During defrost, if the fluid level in the HG tank 84 does not exceed a threshold, the valve 106 on the return conduits 104 and 108 is maintained in an open position and the valve 100 is maintained in a closed position. The warm fluid may be returned from the HG tank 84 into the inlet 64 of the LT compressor 12.

If a fluid level in the HG tank 84 exceeds or reaches a threshold, the high level switch (near the top of the HG tank 84) activates a flush sequence in order to remove liquid from the HG tank 84. When the flush sequence is activated, a valve 106 on the return conduit 108 between the discharge conduit 86 and the inlet 64 of the LT compressor 12 is closed, and a valve 100 (e.g., a flush valve) upstream of the valve 106 along the conduit 108 is opened. The valve 100 may be opened for a period of time in order to maintain enough, but not excessive, pressure to push liquid out of the HG tank 84 into the flash tank 34. The valve 100 may be opened in a manner such that sufficient pressure in the HG tank 84 is maintained to overcome pressure in the flash tank 34 but not so high that a pressure relief valve of the refrigeration system 10 is opened. The valve 106 may be modulated in order to maintain pressure in the HG tank 84 to ensure sufficient pressure for defrosting operations. Once the defrost of the first evaporator 18 has been completed, the valve 24 and the valve 122 are transitioned into the closed position and the refrigeration system 10 resumes normal (e.g., cooling or refrigeration) operations.

Advantageously, the refrigeration system 10 implements a warm fluid or hot gas defrost cycle without requiring a special valve between a compressor and the second defrost header 82. Typically, the use of LT compressors for warm fluid or hot gas defrost requires a hold back (pressure differential) valve in order to raise the pressure of the discharge of the LT compressor in order to produce a sufficient pressure differential of the discharge at the LT compressor such that the warm fluid or hot gas can be driven to enter the evaporators and empty into a flash tank. Other systems use hot gas from the MT compressor 14 which also requires a valve to carefully drop the pressure from the discharge of the MT compressor 14. However, such systems can reach pressures of over 1000 psi or even over 1400 psi which may cause safety concerns, particularly for headers that are protected by a 650 psi pressure relief valve in order to protect evaporators rated for 650 psi. Advantageously, the refrigeration system 10 allows the use of the discharge at the LT compressor 12 for defrost operations without requiring a special intermediate valve since the hot gas or warm fluid is returned to the inlet 64 of the LT compressor 12 instead of being returned directly to a flash tank.

The refrigeration system 10 also uses the HG tank 84 and returns hot gas or warm fluid to the HG tank 84 from the evaporators 18 and 20 during and after defrosting operations using the hot gas or warm fluid. Other systems return the hot gas or warm fluid from the evaporators 18 and 20 to a flash tank instead of to a HG tank 84 separate from the flash tank. The HG tank 84 can still discharge to the flash tank 34 through valve 120 as needed to maintain fluid level below a threshold.

Figure 2:
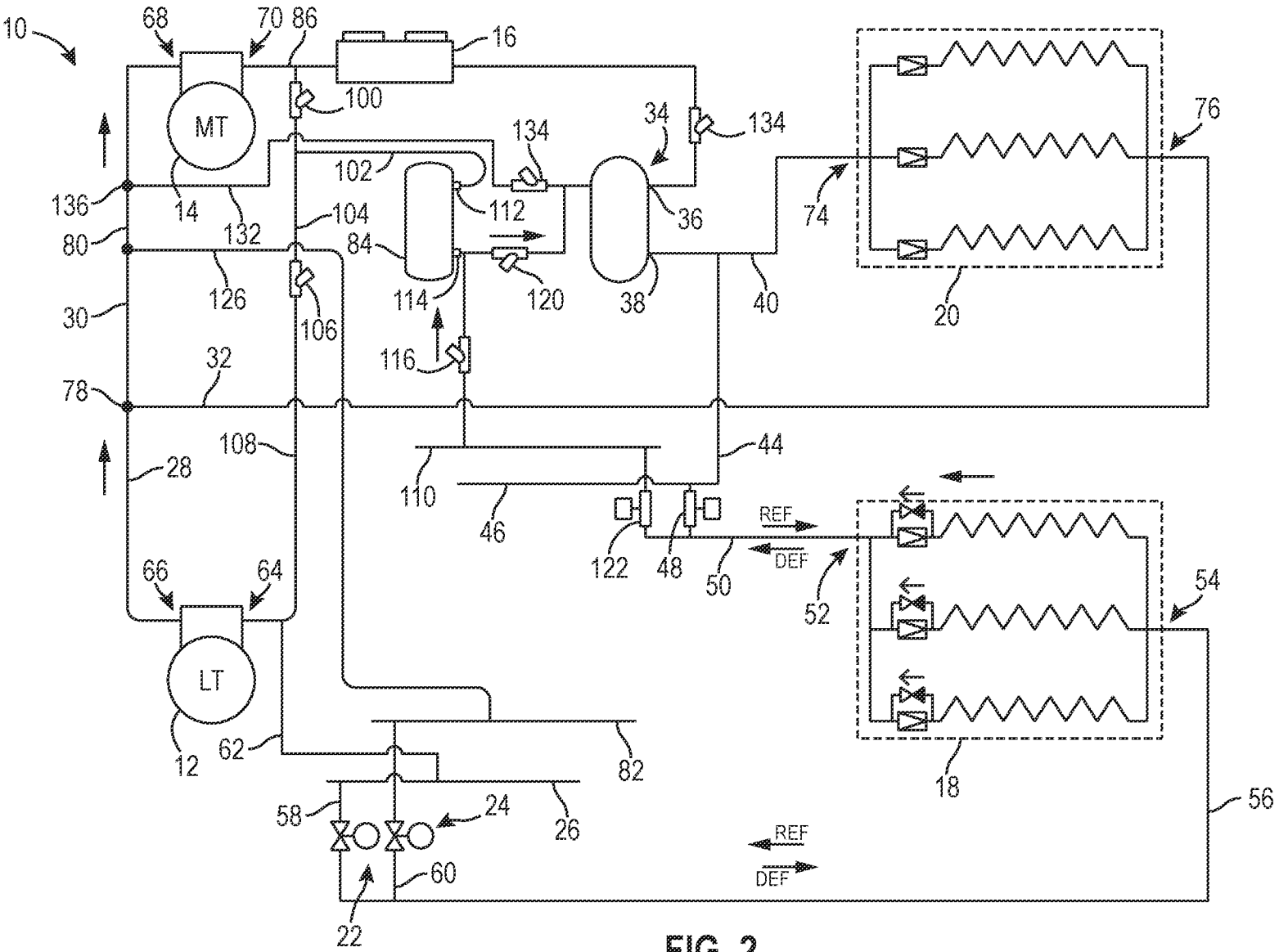
FIG. 2 is a diagram of another refrigeration system that can implement a defrost feature, according to some embodiments.

Referring to FIG. 2, the refrigeration system 10 may include a conduit 126 that is fluidly coupled on an inlet or suction side of the MT compressor 14 at connection point 80. The conduit 126 is configured to provide warm refrigerant (e.g., hot gas or warm fluid) for evaporator defrosting. The conduit 126 provides the warm refrigerant to the second defrost header 82. Advantageously, the refrigeration system 10 as shown in FIG. 2 operates similarly to the embodiment of the refrigeration system described in greater detail above with reference to FIG. 1 for defrosting operations, and uses warm refrigerant from the suction side of the MT compressor 14. While other systems rely on warm refrigerant from either LT compressor discharge or MT compressor discharge, the refrigeration system uses warm refrigerant from the suction side of the MT compressor 14. The connection point 80 is downstream from the connection point 78 and upstream of the suction side 68 of the MT compressor 14.

Figure 3:
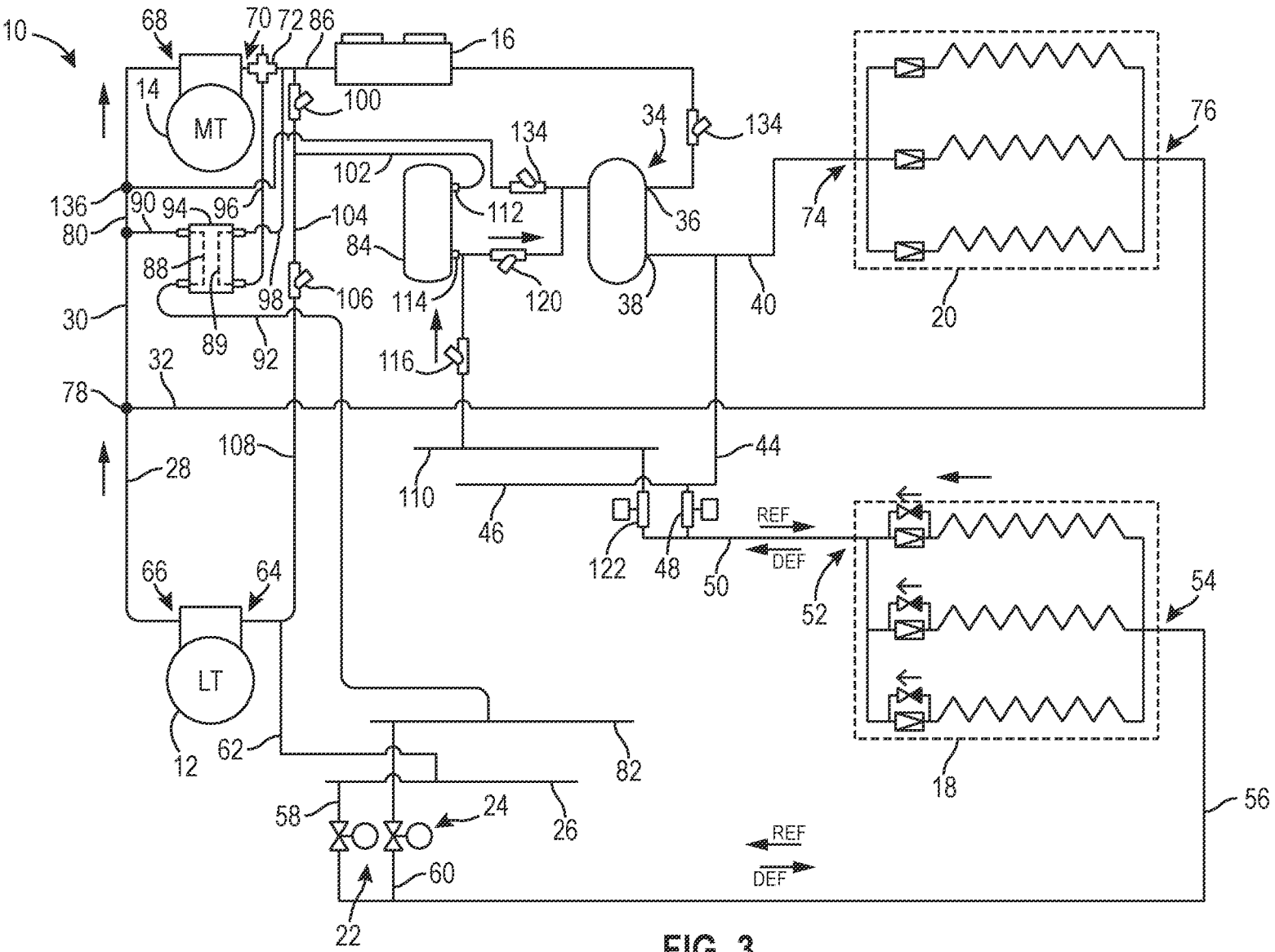
FIG. 3 is a diagram of another refrigeration system that can implement a defrost feature, according to some embodiments.

Referring to FIG. 3, the refrigeration system 10 may include a heat exchanger 94 that is configured to receive refrigerant from the connection point 80 via a conduit 90. The conduit 90 transfers the refrigerant from the connection point 80, through a first conduit 88 of the heat exchanger 94, and into a conduit 92. The conduit 92 is fluidly coupled with the second defrost header 82 and provides the warm refrigerant to the second defrost header 82. The heat exchanger 94 is also configured to receive hot refrigerant via a conduit 96 that fluidly couples on a discharge side of the MT compressor 14 at the discharge conduit 86. The hot refrigerant is discharged from the MT compressor 14, enters the heat exchanger 94 through the conduit 96, passes through a second conduit 89 of the heat exchanger 94, and is returned to the discharge conduit 86 at a position downstream of the connection point of the conduit 96 via conduit 98. As the warm refrigerant from the suction side of the MT compressor 14 is transferred through the first conduit 88 of the heat exchanger 94, the warm refrigerant is heated by the hot refrigerant passing through the second conduit 89. The refrigerant from the suction side of the MT compressor 14, having absorbed heat from the hot refrigerant on the discharge side of the MT compressor 14, is then discharged from the heat exchanger 94 to the second defrost header 82, where is it used by the refrigeration system 10 for defrosting. Advantageously, providing the heat exchanger 94 utilizes the heat of the refrigerant discharged from the MT compressor 14 for defrosting operations, while also using the refrigerant from the suction side on the MT compressor 14 having a more manageable pressure.

Referring still to FIG. 3, the refrigeration system 10 also includes a three-way valve 72 positioned downstream of the MT compressor 14. The three-way valve 72 is configured to receive discharged hot refrigerant directly from the MT compressor 14. The three-way valve 72 is configured to divert the hot refrigerant to either the conduit 96 or to the discharge conduit 86. The three-way valve 72 may be operated based on a temperature obtained along the conduit 92 (e.g., downstream of an outlet of the heat exchanger 94). In some embodiments, the three-way valve 72 is modulated between a first position and a second position based on the temperature obtained along the conduit 92. In some embodiments, the first position is a position in which the hot refrigerant discharged from the MT compressor 14 is passed through to the conduit 86 and the hot refrigerant is not provided to the conduit 96 (e.g., to the heat exchanger 94). In some embodiments, in the second position, the three-way valve 72 is configured to direct hot refrigerant discharged from the MT compressor 14 into the conduit 96 to the heat exchanger 94 in order to pre-heat the refrigerant in the first conduit 88 of the heat exchanger 94 for defrosting operations. In some embodiments, the three-way valve 72 is transitioned or modulated between the first position and the second position based on the temperature of the refrigerant exiting the heat exchanger 94 from the first conduit 88 in order to keep the temperature below a threshold, or to keep the temperature between two thresholds. For example, if refrigerant that is too hot is used for defrosting the evaporators, any ice that is defrosted may be converted into steam. Accordingly, the modulation of the three-way valve 72 is controlled in order to maintain the temperature of the refrigerant used for defrosting operations below a threshold (e.g., an excessively high temperature).

Figure 6:
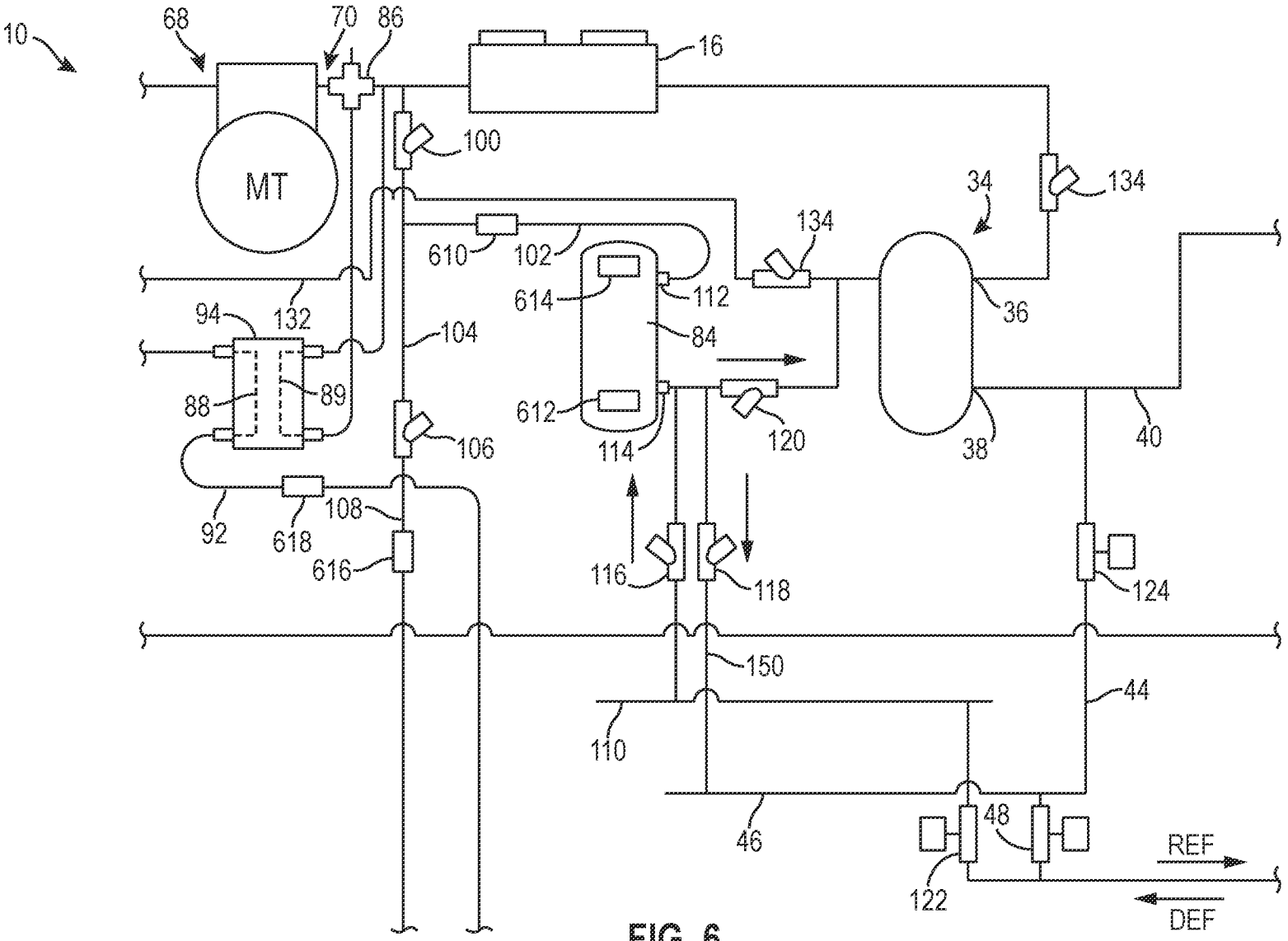
FIG. 6 is a diagram of sensors of any of the refrigeration systems of FIGS. 1-5, according to some embodiments.

Referring particularly to FIGS. 3 and 6, the HG tank 84 includes a low level switch 612 and a high level switch 614. The refrigeration system 10 also includes a pressure transducer 610 positioned along the conduit 102 (e.g., downstream of the outlet 112 of the HG tank 84), and a pressure transducer 616 on a suction side of the LT compressor 12 (e.g., along conduit 108). The refrigeration system 10 also includes a temperature sensor 618 on the conduit 92 that is configured to measure temperature of warm refrigerant (e.g., hot gas, warm liquid) leaving the heat exchanger 94 for defrosting operations. The valve 106 may be operated based on a reading obtained from the pressure transducer 616. In particular, the valve 106 may be modulated (e.g., between an open position and a closed position, or multiple different positions partially open and partially closed) in order to maintain a pressure a particular amount (e.g., 50 psi) above pressure at the suction side of the LT compressor 12, thereby producing a pressure differential between supply and return refrigerant used for defrosting.

Referring still to FIGS. 3 and 6, the low level switch 612 and the high level switch 614 are both monitored during defrost operations. If the high level switch 614 indicates that liquid in the HG tank 84 has reached a high fill level (e.g., a maximum capacity, or a near maximum capacity), the valve 106 is closed, and the valve 100 is operated by referencing readings at the pressure transducer 610 in order to maintain the pressure a particular amount (e.g., 50 psi) above flash tank pressure in order to force excess liquid out of the HG tank 84 to both the evaporator header 46 and the flash tank 34. The valve 100 may be modulated in order to maintain the pressure the particular amount above the flash tank pressure.

Figure 4:
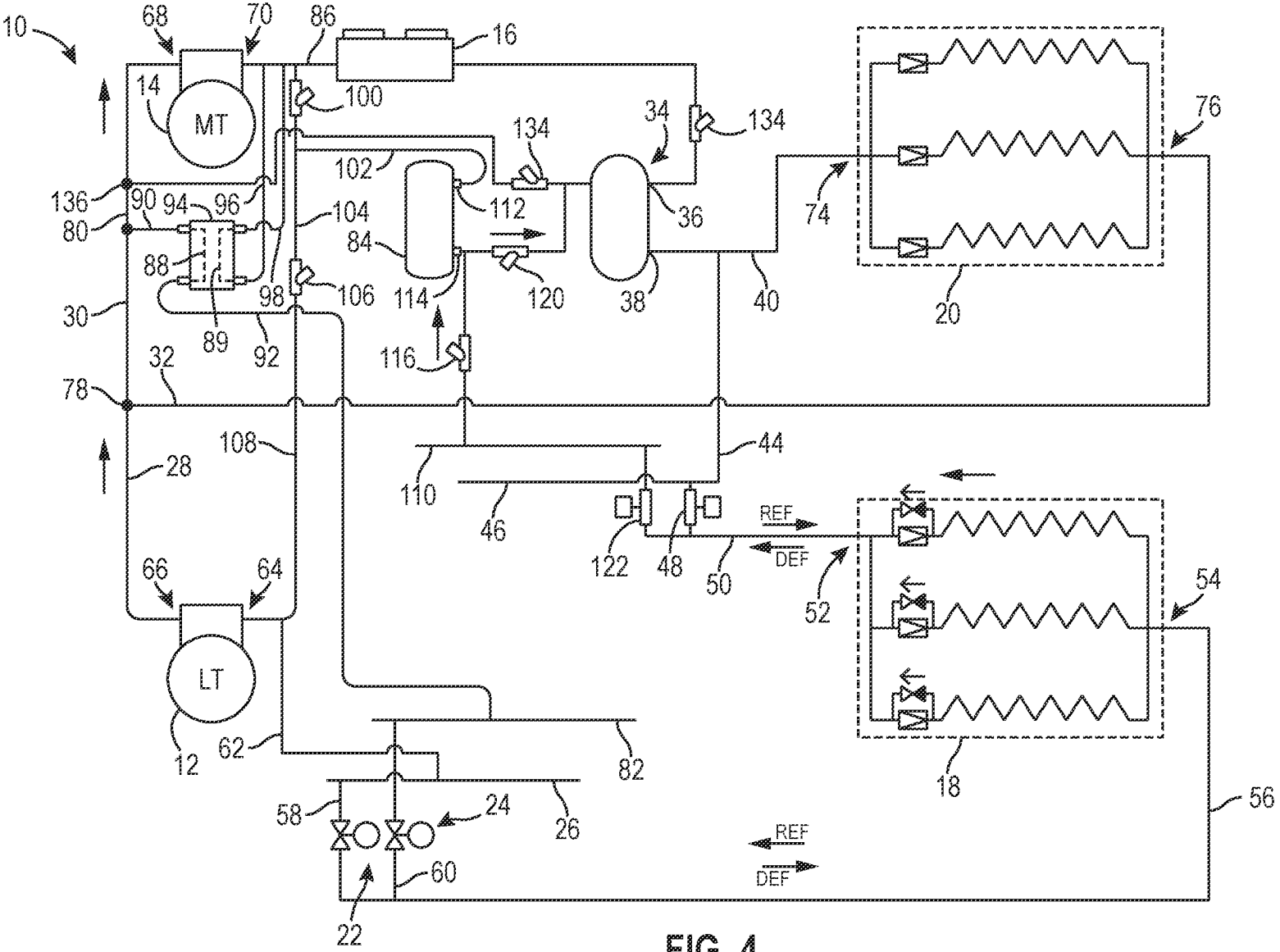
FIG. 4 is a diagram of another refrigeration system that can implement a defrost feature, according to some embodiments.

Referring to FIG. 4, the refrigeration system 10 can be provided similarly as described in greater detail above with reference to FIG. 3, but without the three-way valve 72. If the refrigeration system 10 does not include the three-way valve 72, the MT compressor 14 may be run continually to drive the hot discharged refrigerant to the heat exchanger 94 at all times. Providing the refrigeration system 10 without the three-way valve 72 may reduce cost and complexity of the refrigeration system 10.

Figure 5:
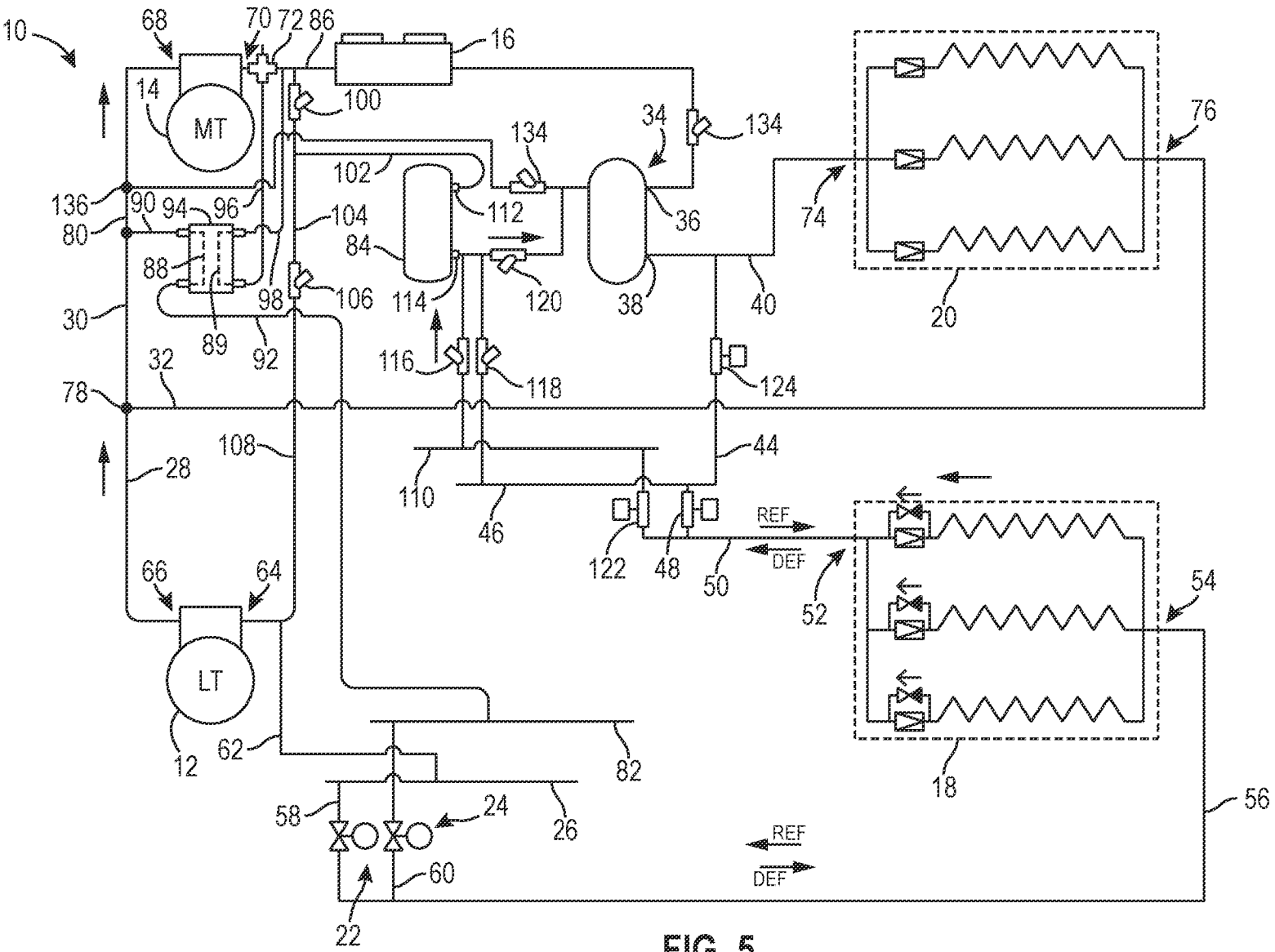
FIG. 5 is a diagram of another refrigeration system that can implement a defrost feature, according to some embodiments.

Referring to FIGS. 5 and 6, the refrigeration system 10 may include a valve 124 positioned along the conduit 44 between the evaporator header 46 and the conduit 40, a conduit 150 fluidly coupling the inlet of the HG tank 84 with the evaporator header 46, and a valve 118 along the conduit 150. The valve 124 may be a solenoid valve or other valve (e.g., a ball valve) that is transitionable between an open position and a closed position. If the HG tank 84 needs to flush to the flash tank 34 during a defrost cycle, this may prolong the duration of the defrost cycle, thus decreasing effectiveness of the refrigeration system 10. In order to use the liquid in the HG tank 84, liquid from the HG tank 84 may be allowed to flow to the evaporator header 46. The fluid in the HG tank 84 is allowed to flow to the evaporator header 46 responsive to detection of the presence of fluid in the HG tank 84 (e.g., based on a reading of the low level switch 612). Responsive to detection of fluid in the HG tank 84 by the low level switch 612 (e.g., detection of 5% fill of the HG tank 84, 10% fill, 15% fill, 20% fill, etc.), the valve 124 is closed and the valve 118 is opened. The valve 118 may be a check valve that only allows flow in a single direction (e.g., into the evaporator header 46). Closing the valve 124 causes the pressure within the evaporator header 46 to begin to drop, which thereby causes the pressure in the evaporator header 46 to decrease below a pressure in the HG tank 84. Once the pressure in the evaporator header 46 decreases below the pressure of the HG tank 84, fluid from the HG tank 84 is drawn into the evaporator header 46 through the conduit 150 and the valve 118. Advantageously, using the fluid in the HG tank 84 facilitates reduced electricity consumption by eliminating electricity consumption normally required to run resistance heaters to defrost coils. The fluid from the HG tank 84 is used by other circuits of the refrigeration system 10 (in refrigeration) and therefore provides a greater quantity of liquid than liquid from the flash tank 34. Since the HG tank 84 provides greater amounts of liquid than the flash tank 34 and is used for defrosting, the HG tank 84 can increase efficiency of evaporators that are operated in refrigeration or cooling modes. It should be understood that the refrigeration system described herein with reference to FIG. 5 may be similar to the refrigeration system as described in greater detail above with reference to FIGS. 1-4, but with the additional feature of using the fluid in the HG tank 84 to reduce electrical consumption of the defrost cycle.

It should be understood that the term "conduit" as described herein can include any hose, line, pipe, fitting, tubular member, or collection of hoses, lines, pipes, fittings, or tubular members in order to define a flow path and fluidly couple components on the flow path with each other.

Control System

Figure 7:
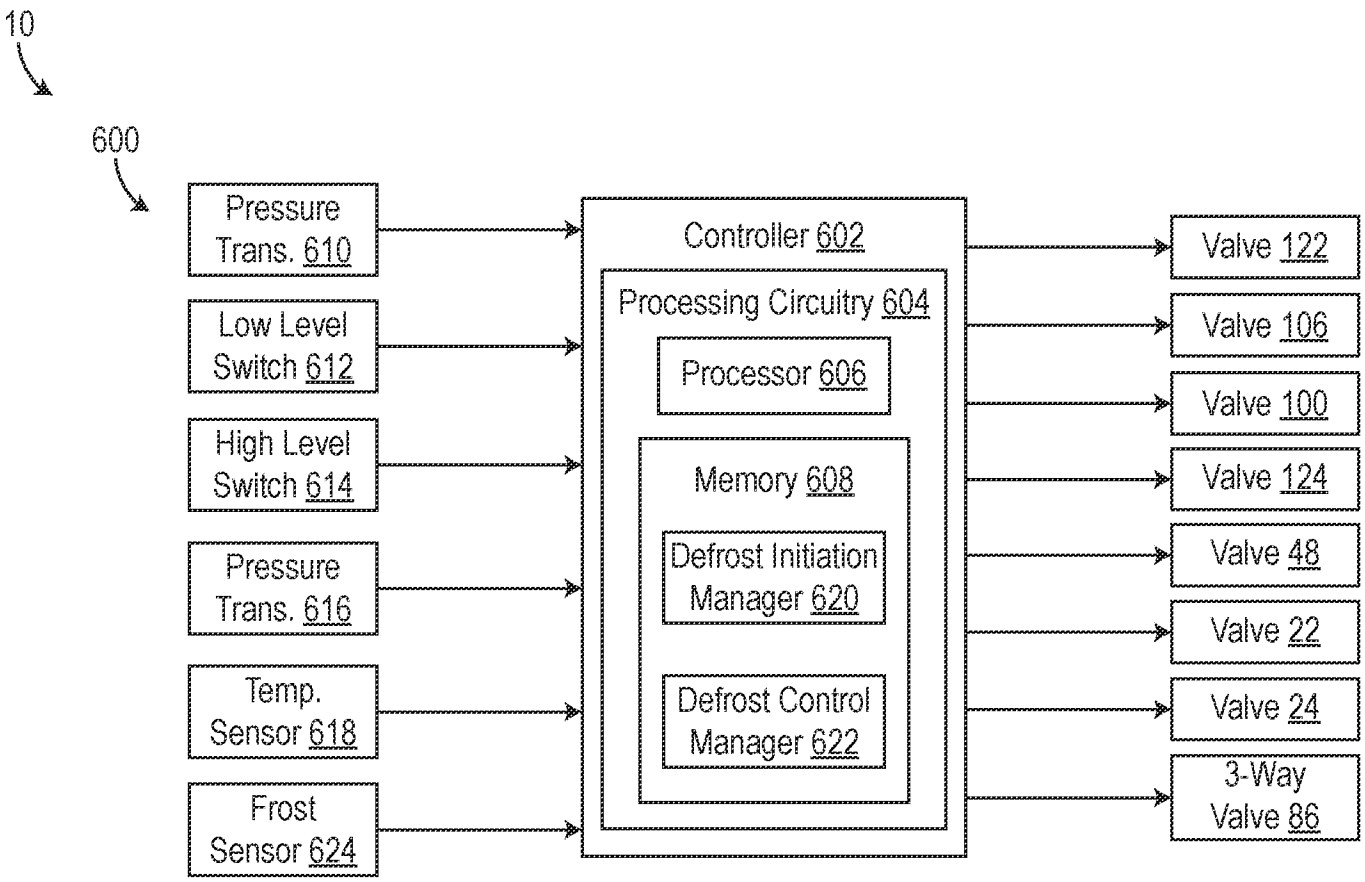
FIG. 7 is a block diagram of a control system for the refrigeration systems of FIGS. 1-5, according to some embodiments.

Referring to FIG. 7, the refrigeration system 10 may include a control system 600 that is configured to operate components of the refrigeration system 10 for both refrigeration operations and defrost operations. In some embodiments, the control system 600 is configured to initiate the defrost operation and to control the components of the refrigeration system 10 as described in greater detail above with reference to FIGS. 1-6 in order to implement the defrost operation (e.g., to control the refrigeration system 10 throughout the defrost operation). The control system 600 includes a controller 602, the pressure transducer 610, the low level switch 612, the high level switch 614, the pressure transducer 616, and the temperature sensor 618. The control system 600 also includes the valve 122, the valve 106, the valve 100, the valve 124, the valve 24, the valve 22, the valve 48, and the three-way valve 86. The controller 602 is configured to receive sensor inputs or readings from the pressure transducer 610, the low level switch 612, the high level switch 614, the pressure transducer 616, and the temperature sensor 618, and generate controls or control signals for the valve 122, the valve 106, the valve 100, the valve 124, the valve 48, the valve 22, the valve 24, and the three-way valve 86 based on the obtained sensor inputs or readings. The control system 600 may also include a frost sensor 624 (e.g., an optical sensor, a temperature sensor, a temperature and humidity sensor, etc.) that is configured to detect the presence of frost on the first evaporator 18 or the second evaporator 20. The controller 602 may also be configured to operate the refrigeration system 10 (e.g., the valves, the LT compressor 12, and the MT compressor 14) in order to perform normal operation (e.g., refrigeration or cooling operations) of the refrigeration system 10. For example, the controller 602 is configured to operate the LT compressor 12 and the MT compressor 14 to circulate refrigerant through the refrigeration system 10 to cool medium temperature and low temperature areas.

Still referring to FIG. 7, the controller 602 shown to include processing circuitry 604 including a processor 606 and memory 608. Processing circuitry 604 can be communicably connected to a communications interface such that processing circuitry 604 and the various components thereof can send and receive data via the communications interface. Processor 606 can be implemented as a general purpose processor, an application specific integrated circuit (ASIC), one or more field programmable gate arrays (FPGAs), a group of processing components, or other suitable electronic processing components.

Memory 608 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 608 can be or include volatile memory or non-volatile memory. Memory 608 can include database components, object code components, script components, or any other type of information structure for supporting the various activities and information structures described in the present application. According to some embodiments, memory 608 is communicably connected to processor 606 via processing circuitry 604 and includes computer code for executing (e.g., by processing circuitry 604 and/or processor 606) one or more processes described herein.

The memory 608 includes a defrost initiation manager 620 and a defrost control manager 622. The defrost initiation manager 620 may include a timer, clock, and/or schedule (e.g., a predetermined, user, or expert defined schedule) that indicates when to implement a defrost operation. The defrost initiation manager 620 is configured to determine when to initiate the defrost operation based on the timer, clock, or schedule, and initiate the defrost operations at the required times. In some embodiments, the defrost initiation manager 620 is configured to use any of the sensor feedback in order to predict or detect (e.g., based on the sensor data from the frost sensor 624) if frost is present on the first evaporator 18 or the second evaporator 20. In some embodiments, the defrost initiation manager 620 is configured to monitor operational characteristics, environmental conditions such as temperature and humidity, a type of refrigerant, an amount of elapsed time since a previous defrosting operation, operational data over the time period since the previous defrosting operation, etc., in order to determine if the defrosting operation should be performed. The defrost initiation manager 620 may also be configured to receive a command from a human machine interface (HMI), a wirelessly connected device, a button set, a control panel, a switch, etc., in order to determine that the defrost operation should be initiated.

Once the defrost initiation manager 620 determines that the defrosting operation should be initiated, the defrost initiation manager 620 may generate control signals to close the valve 124 to restrict liquid from pumping out of the coils in preparation for the defrost operation. Next, the defrost initiation manager 620 operates the valve 22 to close to shut off flow of refrigerant to the suction header 26. The defrost initiation manager 620 then operates the valve 24 to open in order to allow the flow of refrigerant to the second defrost header 82. Finally, the defrost initiation manager 620 operates the valve 122 to open so that refrigerant is allowed to flow into the first defrost header 110. It should be understood that while the operations described herein with reference to the defrost initiation manager 620 are described as being performed sequentially, any of the steps may be performed simultaneously or at least partially simultaneously with each other.

Once the defrost operation has been initiated, the defrost control manager 622 is configured to operate the refrigeration system 10 throughout the defrost operation until the defrost operation has finished, at which time the defrost initiation manager 620 performs the above described operations in reverse. After the defrost initiation manager 620 performs the defrost initiation steps in reverse, the refrigeration system 10 resumes normal operation and provides cooling to the medium temperature and low temperature spaces.

The defrost control manager 622 is configured to use feedback from the pressure transducer 616 in order to control the valve 106. In some embodiments, the defrost control manager 622 modulates the valve 106 in order to maintain the pressure read by the pressure transducer 616 a predetermined amount (e.g., 50 psi) above the suction pressure at the LT compressor 12 to thereby produce a pressure differential between supply and return. The defrost control manager 622 is configured to operate the three-way valve 86 to open in order to provide hot refrigerant to the heat exchanger 94 through the conduit 96 (e.g., to add latent heat to the warm fluid for defrosting). The defrost control manager 622 is configured to monitor feedback from both the low level switch 612 and the high level switch 614. In response to signals from the low level switch 612 indicating the presence of liquid in the HG tank 84, the defrost control manager 622 is configured to operate the valve 124 to close to thereby shut off fluid flow to the evaporator header 46 from the flash tank 34. Closing the valve 124 causes the pressure in the evaporator header 46 to drop such that liquid from the HG tank 84 is drawn into the evaporator header 46 through the conduit 150 and the valve 118.

In response to signals from the high level switch 614 indicating that the fluid level in the HG tank 84 has reached an upper threshold, the defrost control manager 622 is configured to operate the valve 106 to transition into a closed position (e.g., limiting the return of fluid from the HG tank 84 to the LT compressor 12 through the conduit 108). The defrost control manager 622 is configured to obtain sensor data or feedback from the transducer 610 and modulate the valve 100 (e.g., between an open and closed position, into different positions between open and closed, etc.) in order to maintain the reading at the pressure transducer 610 a predetermined amount above the flash tank pressure of the flash tank 34 such that fluid from the HG tank 84 is transferred into the flash tank 34 until the level of fluid in the HG tank 84 decreases to an acceptable level.

The defrost control manager 622 may be configured to monitor temperature readings obtained from the temperature sensor 618 in order to verify the exchange of heat at the heat exchanger 94. The defrost control manager 622 may also operate the three-way valve 86 based on the temperature readings obtained form the temperature sensor 618 in order to ensure that the temperature of the refrigerant used for the defrost operation does not exceed a maximum allowable temperature. If the temperature of the hot refrigerant used for defrosting begins to approach or exceed an acceptable level, the defrost control manager 622 may modulate or control the three-way valve 86 such that a reduced amount or flow rate of hot refrigerant discharged from the MT compressor 14 is provided to the heat exchanger 94.

Figure 8:
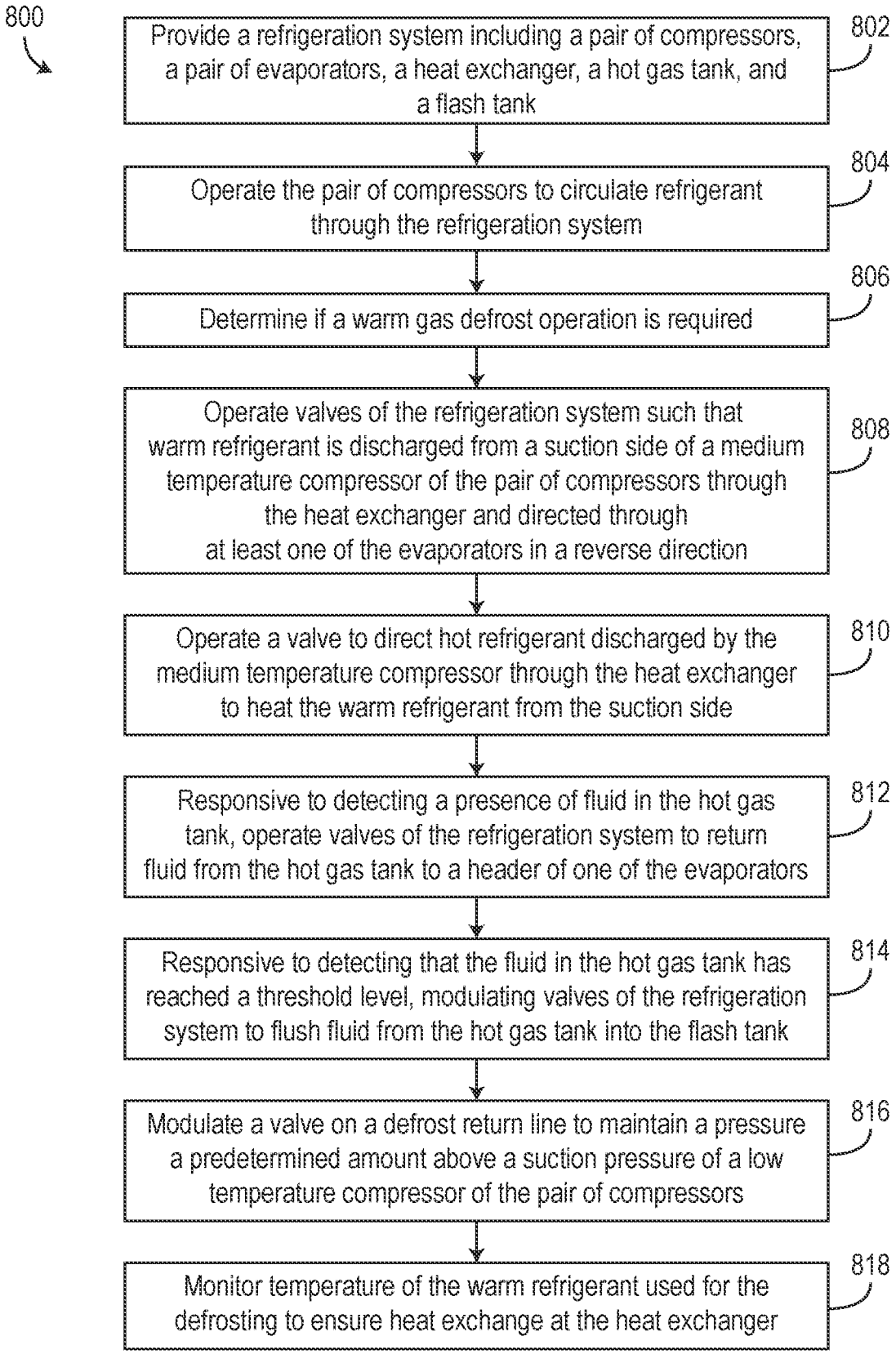
FIG. 8 is a flow diagram of a process for controlling the refrigeration systems of FIGS. 1-5 to perform a defrost operation, according to some embodiments.

Referring to FIG. 8, a flow diagram of a process 800 for operating the refrigeration system 10 includes steps 802-818, according to some embodiments. The process 800 may be performed by the control system 600, or more specifically, by the controller 602 in order to perform a defrosting operation. The process 800 advantageously uses warm refrigerant from a suction side of the MT compressor 14 which is serially fluidly coupled with the LT compressor 12.

The process 800 includes providing a refrigeration system including a pair of compressors, a pair of evaporators, a heat exchanger, a hot gas tank, and a flash tank (step 802), and operating the pair of compressors to circulate refrigerant through the refrigeration system (step 804), according to some embodiments. In some embodiments, the refrigeration system is the refrigeration system 10 (e.g., as described in greater detail above with reference to FIG. 5). The pair of compressors may be arranged in series and include both a low temperature (LT) compressor and a medium temperature (MT) compressor. The evaporators include an MT evaporator and a LT evaporator that are configured to provide different amounts of cooling to different zones (e.g., the MT evaporator cools a refrigerated zone and the LT compressor cools a freezer zone). When step 804 is performed and refrigeration operations are implemented by control of the controller 602, the LT compressor discharges refrigerant to a suction side of the MT compressor. The MT compressor discharges the refrigerant through a gas cooler which is then transferred to the flash tank. The flash tank provides refrigerant to both the evaporators to cool the respective zones. The refrigerant from the MT evaporator is returned at a connection point downstream of the discharge of the LT compressor and upstream of a suction of the MT compressor. The refrigerant from the LT compressor is provided to the LT evaporator through an evaporator header and returned to the suction side of the LT compressor through another evaporator header.

The process 800 includes determining if a warm gas defrost operation is required (step 806), according to some embodiments. In some embodiments, step 806 is performed by the defrost initiation manager 620. The defrost initiation manager 620 may use sensor feedback, a schedule, a clock, etc., in order to determine if the warm gas defrost operation should be performed and to initiate the warm gas defrost operation when necessary.

The process 800 includes operating valves of the refrigeration system such that warm refrigerant discharged from a suction side of a medium temperature (MT) compressor of the pair of compressors through the heat exchanger and directed through at least one of the evaporators in a reverse direction (step 808), according to some embodiments. The process 800 also includes operating a valve to direct hot refrigerant discharged by the medium temperature compressor through the heat exchanger to heat the warm refrigerant from the suction side (step 810), according to some embodiments. In some embodiments, step 808 is performed by the controller 602 by initiating a sequence of valve operations such that warm refrigerant is passed through the evaporator in a reverse direction as used for cooling. The pair of compressors may continue to operate in a regular manner to discharge refrigerant, but the refrigerant is drawn from the suction side of the medium temperature compressor in order to defrost the coils of the evaporator. The heat exchanger is configured to provide latent heat to the refrigerant drawn from the suction side of the medium temperature compressor by passing hot refrigerant from a discharge side of the medium temperature compressor (from a point upstream of the gas cooler) into the heat exchanger. Step 808 may include or be implemented by closing a supply valve (e.g., valve 48) for the evaporator at an inlet of the evaporator such that refrigerant can not be transferred into the evaporator in a normal direction (e.g., the direction of flow for refrigeration). Step 808 can also include or be implemented by closing a valve (e.g., valve 22) that supplies return refrigerant from the evaporator (e.g., the LT evaporator) to the suction header upstream of a suction side of the LT compressor. Step 808 can also include or be implemented by opening a valve (e.g., valve 24) that allows the flow of refrigerant from the suction side of the MT compressor to an outlet of the evaporator such that warm refrigerant can flow into the evaporator in the reverse direction. Step 808 can also include or be implemented by opening a valve (e.g., valve 122) so that refrigerant that exits the inlet of the evaporator during defrost (e.g., in the reverse direction) can flow to the HG tank through a corresponding header. In this way, operating the valves of step 808 causes a flow path in a regular direction to be closed and opens a flow path through the evaporator in the reverse direction from the suction side of the MT compressor to the suction side of the LT compressor.

Step 810 can include or be implemented by operating a three-way valve that is downstream of a discharge side of the MT compressor so that hot refrigerant discharged by the MT compressor is transferred to the heat exchanger for providing latent heat to the refrigerant used for the defrosting operation. Steps 808 and 810 may be performed by the controller 602 which generates control signals for any of the valves described herein.

The process 800 includes, responsive to detecting a presence of fluid in the hot gas tank, operating valves of the refrigeration system to return fluid from the hot gas tank to a header of one of the evaporators (step 812), according to some embodiments. In some embodiments, step 812 is performed by the controller 602 in response to receiving a signal from the low level switch 612 indicating that fluid is present in the HG tank 84. Step 812 can include operating a valve (e.g., valve 124) to shut off flow of fluid from the flash tank to a header that is used for the LT evaporator during refrigeration. This causes the pressure in the header to drop such that refrigerant from the hot gas tank is drawn into the header that is normally used for refrigeration operation. Allowing the hot gas tank to exchange refrigerant with the header that is upstream of the evaporator during refrigeration operations reduces an amount of time that the defrost operation takes.

The process 800 includes, responsive to detecting that the fluid in the hot gas tank has reached a threshold level, modulating valves of the refrigeration system to flush fluid from the hot gas tank into the flash tank (step 814), according to some embodiments. In some embodiments, step 814 is performed by the controller 602 using feedback from the high level switch 614 of the HG tank 84. If the fluid level in the hot gas tank reaches the upper threshold as detected by the high level switch 614, a valve (e.g., valve 106) on the return line to the suction side of the LT compressor is closed such that the refrigerant is not returned to the LT compressor. Step 814 also includes modulating a position of a valve (e.g., valve 100) that fluidly couples with a discharge of the MT compressor based on readings from a transducer on a high level outlet of the hot gas tank in order to maintain pressure in the hot gas tank an amount above the flash tank pressure. Maintaining the pressure in the hot gas tank above the flash tank pressure causes the hot gas tank to flush fluid into the flash tank.

The process 800 includes modulating a valve on a defrost return line to maintain a pressure a predetermined amount above a suction pressure of a low temperature compressor of the pair of compressors (step 816), according to some embodiments. In some embodiments, step 816 is performed by the controller 602 based on feedback received from the pressure transducer 616 (e.g., the pressure at the suction side of the LT compressor) by modulating valve 106. The valve may be modulated in order to maintain a pressure differential between supply and return. It should be understood that step 816 may be performed continuously throughout the defrost cycle or at different times in the defrost cycle, and that the steps of process 800 described herein with reference to FIG. 8 should not be understood as necessarily being sequential in time.

The process 800 includes monitoring a temperature of the warm refrigerant used for the defrosting to ensure heat exchange is occurring at the heat exchanger (step 818), according to some embodiments. In some embodiments, step 818 is performed by the controller 602 by monitoring temperature readings obtained from a temperature sensor (e.g., temperature sensor 618) that is downstream of an outlet of the heat exchanger and configured to measure the temperature of the refrigerant used for defrosting. If the temperature becomes excessive, the controller 602 may modulate the three-way valve 86 to reduce the amount of heat transfer at the heat exchanger 94.

Figure 9:
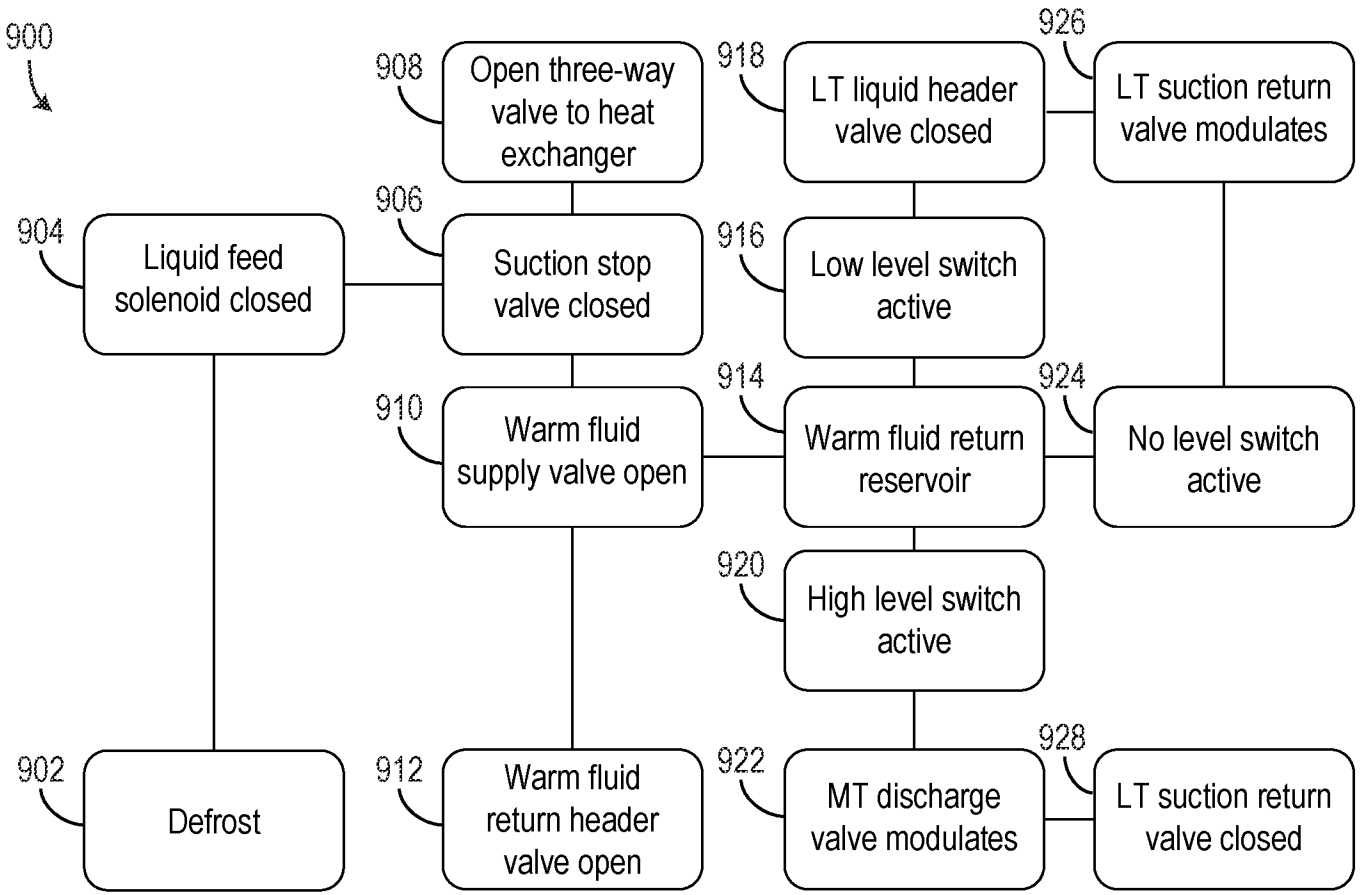
FIG. 9 is a diagram of a process for controlling the refrigeration systems of FIGS. 1-5 to perform a defrost operation, according to some embodiments.

Referring to FIG. 9, a diagram 900 illustrates different steps in the defrosting process, according to some embodiments. The diagram 900 illustrates control steps and sequences implemented by the refrigeration system 10 in order to perform the defrosting operation using reverse-flow of warm refrigerant through evaporators of the refrigeration system 10. The defrost process begins at step 902 when it is determined that defrosting operations should be implemented (e.g., responsive to a schedule or a determination that frost is present on the coils of the evaporator).

Once the defrosting process is initiated, a liquid feed solenoid (e.g., valve 48) is closed at step 904 and a suction stop valve (e.g., valve 22) is closed at step 906. The evaporator is now restricted from receiving refrigerant in the normal direction that it travels during refrigeration operation. The three-way valve 86 is opened (step 908) in order to direct discharged refrigerant from the MT compressor 14 to the heat exchanger 94 and a warm fluid supply valve (e.g., valve 24) is opened (step 910). The warm fluid supply valve receives warm refrigerant from a suction side of the MT compressor 14 and, when open, allows the warm refrigerant to enter the evaporator 18 in the reverse direction (e.g., to enter an outlet of the evaporator 18). A warm fluid return header valve (e.g., valve 122) is also opened (step 912) to allow the return of the warm refrigerant used for defrosting. A fluid level of a warm fluid return reservoir (e.g., the HG tank 84) is monitored (step 914) and if a low level switch is active (step 916), a LT liquid header valve (e.g., valve 124) is closed (step 918) and a LT suction return valve (e.g., valve 106) is modulated until no level switch is active (step 924). If a high level switch is active (step 920), a MT discharge valve (e.g., valve 100) is modulated (step 922) and the LT suction return valve (e.g., valve 106) is closed (step 928).

Configuration of Exemplary Embodiments

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claim.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration.

In some embodiments, particular processes and methods may be performed by circuitry that is specific to a given function. The memory (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit and/or the processor) the one or more processes described herein. References to "a" or "the" processor should be understood to encompass a plurality of processors individually or collectively configured to carry out operations as described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A refrigeration system comprising:

a low temperature (LT) compressor;

a medium temperature (MT) compressor, a suction side of the MT compressor fluidly coupled with a discharge side of the LT compressor;

a low temperature evaporator configured to provide cooling to a low temperature space;

a medium temperature evaporator configured to provide cooling to a medium temperature space; and a heat exchanger;

wherein the refrigeration system is configured to perform a refrigeration cycle to maintain the medium temperature space at a first temperature and the low temperature space at a second temperature lower than the first temperature, refrigerant from the low temperature evaporator returned to a suction side of the LT compressor, and refrigerant from the medium temperature evaporator returned to a connection point downstream of a discharge side of the LT compressor and upstream of a suction side of the MT compressor;

wherein the refrigeration system is configured to perform a defrost cycle by using warm refrigerant from a suction side of the MT compressor and directing the warm refrigerant to pass through the low temperature evaporator in a reverse direction, the warm refrigerant used for the defrost cycle drawn from a position downstream of the connection point and upstream of the suction side of the MT compressor; and wherein the warm refrigerant passes through the heat exchanger before entering the low temperature evaporator for defrosting, the warm refrigerant configured to absorb latent heat while passing through the heat exchanger.

2. The refrigeration system of claim 1, further comprising:

a flash tank fluidly coupled with an outlet of a gas cooler fluidly coupled with a discharge side of the MT compressor, the flash tank fluidly coupled with an inlet of the medium temperature evaporator and, through a header, an inlet of the low temperature evaporator; and a hot gas tank fluidly coupled at a lower end with an inlet of the low temperature evaporator and configured to receive the warm refrigerant returned from the inlet of the low temperature evaporator during the defrost cycle, an outlet of the hot gas tank fluidly coupled with the suction side of the LT compressor to return the warm refrigerant to the LT compressor.

3. The refrigeration system of claim 2, wherein in response to a presence of fluid being detected in the hot gas tank, the refrigeration system is configured to allow refrigerant from the hot gas tank to return to the header by closing a valve that fluidly couples an outlet of the flash tank with the header, closing the valve causing a pressure drop to occur in the header which draws the refrigerant from the hot gas tank into the header.

4. The refrigeration system of claim 2, wherein in response to fluid in the hot gas tank being at an upper threshold of fill level, the refrigeration system is configured to implement a flush cycle by (1) closing a return valve to restrict the return of refrigerant from the hot gas tank to the suction side of the LT compressor, and (2) modulating a valve that fluidly couples the hot gas tank with the discharge side of the MT compressor to maintain a pressure in the hot gas tank at least a specific amount above a pressure of the flash tank such that refrigerant exits the hot gas tank and is flushed into the flash tank.

5. The refrigeration system of claim 1, wherein the refrigerant is carbon dioxide (CO2).

6. The refrigeration system of claim 1, wherein the refrigeration system further comprises a three-way valve positioned downstream of the discharge side of the MT compressor, the three-way valve configured to transition into a position to direct hot refrigerant from the MT compressor into the heat exchanger to provide latent heat to the warm refrigerant for defrosting.

7. A refrigeration system comprising:

a low temperature (LT) compressor and medium temperature (MT) compressor, a suction side of the MT compressor fluidly coupled with a discharge of the LT compressor;

a low temperature evaporator configured to provide cooling to a low temperature space and a medium temperature evaporator configured to provide cooling to a medium temperature space, the LT compressor and the MT compressor configured to discharge a refrigerant through the low temperature evaporator and the medium temperature evaporator for refrigeration; and a control system for the refrigeration system, the control system comprising processing circuitry configured to:

initiate a defrost cycle for the refrigeration system by closing a return valve to shut off refrigerant return to the LT compressor from an outlet of the low temperature evaporator and opening a defrost supply valve to define a fluid flow path between a suction side of the MT compressor and an outlet of the low temperature evaporator; and operate the LT compressor and the MT compressor such that warm refrigerant from the suction side of the MT compressor is provided through the low temperature evaporator and returned to a suction side of the LT compressor through a hot gas tank.

8. The refrigeration system of claim 7, wherein the processing circuitry is further configured to:

operate a three-way valve to direct hot refrigerant from a discharge side of the MT compressor to flow through a heat exchanger through which the warm refrigerant from the suction side of the MT compressor flows such that the warm refrigerant from the suction side of the MT compressor absorbs heat from the hot refrigerant from the discharge side of the MT compressor while passing through the heat exchanger before entering the low temperature evaporator for defrosting;

obtain, from a temperature sensor, a temperature of the warm refrigerant after the warm refrigerant passes through the heat exchanger; and at least one of verify heat exchange at the heat exchanger based on the temperature or control the three-way valve to adjust the temperature of the warm refrigerant.

9. The refrigeration system of claim 7, wherein the processing circuitry is further configured to:

modulate a return refrigerant valve on a return line from the hot gas tank to the suction side of the LT compressor to maintain a pressure differential between a supply and a return of the warm refrigerant for the defrost cycle.

10. The refrigeration system of claim 7, wherein the processing circuitry is configured to:

obtain feedback from a low level switch of the hot gas tank, the feedback of the low level switch indicating a presence of fluid in the hot gas tank; and responsive to the feedback from the low level switch indicating the presence of fluid in the hot gas tank, allowing refrigerant to exit the hot gas tank into a refrigeration header of the low temperature evaporator by closing a valve that fluidly couples an outlet of a flash tank with the refrigeration header to produce a pressure drop in the refrigeration header such that the refrigerant in the hot gas tank is drawn into the refrigeration header.

11. The refrigeration system of claim 7, wherein the processing circuitry is configured to:

obtain feedback from a high level switch of the hot gas tank, the feedback of the high level switch indicating that fluid in the hot gas tank has reached an upper threshold; and responsive to the feedback from the high level switch indicating that fluid in the hot gas tank has reached the upper threshold, performing a flush sequence to flush refrigerant from the hot gas tank into a flash tank fluidly coupled with the hot gas tank, the flush sequence performed by closing a return defrost valve that fluidly couples the hot gas tank with the suction side of the LT compressor and modulating a valve that fluidly couples the hot gas tank with the discharge of the MT compressor in order to maintain pressure in the hot gas tank above a pressure of the flash tank such that the refrigerant in the hot gas tank is flushed into the flash tank.

12. The refrigeration system of claim 7, wherein the refrigerant is carbon dioxide (CO2).

13. A method for defrosting an evaporator of a refrigeration system, the method comprising:

providing a refrigeration system comprising a low temperature (LT) compressor, a medium temperature (MT) compressor, a low temperature evaporator, and a medium temperature evaporator, wherein a suction side of the MT compressor is fluidly coupled with a discharge of the LT compressor, the low temperature evaporator is configured to provide cooling to a low temperature space and the medium temperature evaporator configured to provide cooling to a medium temperature space, the LT compressor and the MT compressor configured to discharge a refrigerant through the low temperature evaporator and the medium temperature evaporator for refrigeration;

initiating a defrost cycle for the refrigeration system by closing a return valve to shut off refrigerant return to the LT compressor from an outlet of the low temperature evaporator and opening a defrost supply valve to define a fluid flow path between a suction side of the MT compressor and an outlet of the low temperature evaporator; and operating the LT compressor and the MT compressor such that warm refrigerant from the suction side of the MT compressor is provided through the low temperature evaporator and returned to a suction side of the LT compressor through a hot gas tank.

14. The method of claim 13, further comprising:

operating a three-way valve to direct hot refrigerant from a discharge side of the MT compressor to flow through a heat exchanger through which the warm refrigerant from the suction side of the MT compressor flows such that the warm refrigerant from the suction side of the MT compressor absorbs heat from the hot refrigerant from the discharge side of the MT compressor while passing through the heat exchanger before entering the low temperature evaporator for defrosting;

obtaining, from a temperature sensor, a temperature of the warm refrigerant after the warm refrigerant passes through the heat exchanger; and at least one of verifying heat exchange at the heat exchanger based on the temperature or controlling the three-way valve to adjust the temperature of the warm refrigerant.

15. The method of claim 13, further comprising:

modulating a return refrigerant valve on a return line from the hot gas tank to the suction side of the LT compressor to maintain a pressure differential between a supply and a return of the warm refrigerant for the defrost cycle.

16. The method of claim 13, further comprising obtaining feedback from a low level switch of the hot gas tank, the feedback of the low level switch indicating a presence of fluid in the hot gas tank; and responsive to the feedback from the low level switch indicating the presence of fluid in the hot gas tank, allowing refrigerant to exit the hot gas tank into a refrigeration header of the low temperature evaporator by closing a valve that fluidly couples an outlet of a flash tank with the refrigeration header to produce a pressure drop in the refrigeration header such that the refrigerant in the hot gas tank is drawn into the refrigeration header.

17. The method of claim 13, further comprising:

obtaining feedback from a high level switch of the hot gas tank, the feedback of the high level switch indicating that fluid in the hot gas tank has reached an upper threshold; and responsive to the feedback from the high level switch indicating that fluid in the hot gas tank has reached the upper threshold, performing a flush sequence to flush refrigerant from the hot gas tank into a flash tank fluidly coupled with the hot gas tank, the flush sequence performed by closing a return defrost valve that fluidly couples the hot gas tank with the suction side of the LT compressor and modulating a valve that fluidly couples the hot gas tank with the discharge of the MT compressor in order to maintain pressure in the hot gas tank above a pressure of the flash tank such that the refrigerant in the hot gas tank is flushed into the flash tank.

18. The method of claim 13, wherein the refrigerant is carbon dioxide (CO2).

19. The method of claim 13, wherein the warm refrigerant is drawn from the suction side of the MT compressor downstream of a connection point at which refrigerant returns from the medium temperature evaporator during a refrigeration cycle.

* * * * *